US009259610B2

(12) United States Patent
Huang et al.

(10) Patent No.: US 9,259,610 B2
(45) Date of Patent: Feb. 16, 2016

(54) EXERCISE DEVICE PROVIDING ADJUSTABLE STEP DISTANCE

(71) Applicant: Dyaco International Inc., Taipei (TW)

(72) Inventors: Hsuan-Fu Huang, Taipei (TW); Han-Lin Liu, Taipei (TW)

(73) Assignee: DYACO INTERNATIONAL INC., Taipei (TW)

( * ) Notice: Subject to any disclaimer, the term of this patent is extended or adjusted under 35 U.S.C. 154(b) by 63 days.

(21) Appl. No.: 14/247,564

(22) Filed: Apr. 8, 2014

(65) Prior Publication Data

US 2015/0238809 A1 Aug. 27, 2015

(30) Foreign Application Priority Data

Feb. 26, 2014 (TW) ..... 103106375 A

(51) Int. Cl.

| | |
|---|---|
| ***A63B 22/06*** | (2006.01) |
| ***A63B 22/00*** | (2006.01) |
| ***A63B 21/22*** | (2006.01) |
| *A63B 22/20* | (2006.01) |

(52) U.S. Cl.

CPC ..... *A63B 22/0664* (2013.01); *A63B 21/225* (2013.01); *A63B 22/001* (2013.01); *A63B 22/0015* (2013.01); *A63B 22/203* (2013.01); *A63B 2022/0676* (2013.01)

(58) Field of Classification Search

CPC ..... A63B 22/0664; A63B 22/225; A63B 2022/0676; A63B 2022/067; A63B 2022/0682; A63B 2022/0688; A63B 22/0605; A63B 2022/0652; A63B 2022/0611; A63B 2022/0617; A63B 2022/0623; A63B 2022/0629; A63B 2022/0635; A63B 2022/0641; A63B 2022/0647

See application file for complete search history.

(56) References Cited

U.S. PATENT DOCUMENTS

| | | | | |
|---|---|---|---|---|
| 7,104,929 | B1 * | 9/2006 | Eschenbach | 482/52 |
| 7,435,204 | B2 * | 10/2008 | Wu et al. | 482/52 |
| 7,674,205 | B2 * | 3/2010 | Dalebout et al. | 482/52 |
| 7,862,482 | B1 * | 1/2011 | Hsu | 482/52 |
| 8,979,713 | B2 * | 3/2015 | Huang et al. | 482/52 |
| 9,050,485 | B2 * | 6/2015 | Huang et al. | |
| 2013/0237379 | A1 * | 9/2013 | Huang et al. | 482/52 |
| 2014/0194253 | A1 * | 7/2014 | Huang et al. | 482/52 |

FOREIGN PATENT DOCUMENTS

CN 201572487 U 9/2010

* cited by examiner

*Primary Examiner* — Loan H Thanh
*Assistant Examiner* — Megan Anderson
(74) *Attorney, Agent, or Firm* — Huffman Law Group, PC

(57) ABSTRACT

An exercise device comprises a frame, a rotational mechanism, a left and a right coupling mechanism, and an adjusting assembly. A post structure is upwardly extended from the front portion of the frame. The rotational mechanism is arranged at the post structure. The left and right coupling mechanisms are arranged at a side of the post, respectively. One end of the left and right coupling mechanism couples to the rotational mechanism, and the other end respectively comprise a left and a right pedal assembly making a moving path. The adjusting assembly comprises a left and a right linkage structures with two ends, in which one end couples to the post and the other end moveably couples to the left and right pedal assembly. By changing the angles between the left and right linkage structures and the post structure, the pedal assemblies are moved to determine a step distance.

8 Claims, 6 Drawing Sheets

1

EXERCISE DEVICE PROVIDING ADJUSTABLE STEP DISTANCE

CROSS-REFERENCE TO RELATED APPLICATIONS

The entire contents of Taiwan Patent Application No. 103106375, filed on Feb. 26, 2014, from which this application claims priority, are incorporated herein by reference.

BACKGROUND OF THE INVENTION

1. Field of the Invention

The present invention relates to an exercise device, and more particularly relates to exercise device providing adjustable step distance.

2. Description of Related Art

An elliptical trainer, also called a cross-trainer or an X-trainer, is a stationary exercise machine to simulate stair climbing, walking, or running.

The elliptical trainer does not cause excessive pressure to the joints as the two legs simultaneously share the burden, hence decreasing the risk of impact injuries.

The elliptical trainer typically includes two pedals. A user steps on the pedals and the operation of the elliptical trainer cause the pedals to provide a moving path. For conventional elliptical trainers, the path of the pedals cannot be varied.

A Taiwan Patent, Publication No., M403355, entitled "Rising Device for Elliptical Trainers," discloses an elliptical trainer with a rising device that can adjust the path of the pedals. However, the distance between the two pedals is fixed.

FIG. 1 shows an elliptical trainer 1 having a fixed step distance of 20 inches. Because the users have varied heights, the elliptical trainer 1 could not suitable to all users, and the optimum training effect cannot be achieved.

SUMMARY OF THE INVENTION

In one general aspect, the present invention relates to an exercise device, and more particularly relates to exercise device providing elliptical or elliptical-like paths.

In an embodiment of the present invention, an exercise device is provided with a frame, a rotational mechanism, a left coupling mechanism and a right coupling mechanism, and an adjusting mechanism. The frame has a post structure extended upward from a top portion of the frame. The rotational mechanism is placed at the post structure. The left linkage mechanism and the right linkage mechanism are respectively arranged at either side of the post structure. The left linkage mechanism and the right linkage mechanism have two ends in which one end couples with the rotational mechanism and the other end couples with a left pedal assembly and a right pedal assembly, respectively. The adjusting mechanism comprises a left linkage structure and a right linkage structure having two end in which one end couples with the post structure and the other end couples with the left pedal assembly and the right pedal assembly, respectively; whereby an angle between the left linkage structure and the post structure and an angle between the right linkage structure and the post structure are adjustable so as to determine a step distance between the left pedal assembly and the right pedal assembly.

DETAILED DESCRIPTION OF THE PREFERRED EMBODIMENT

Figure 1:
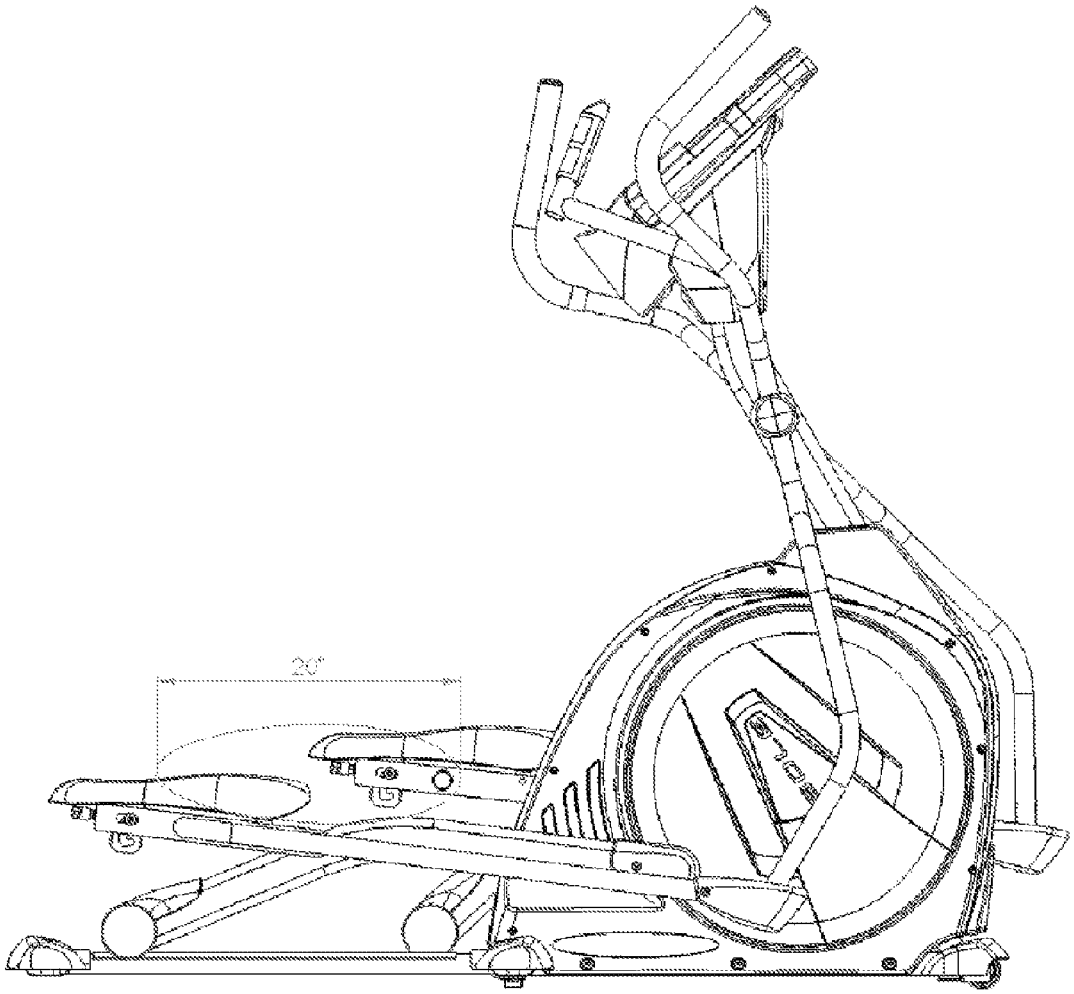
FIG. 1 is a front view showing a fixed step distance of conventional elliptical trainers.

Embodiments of the invention are now described and illustrated in the accompanying drawings, instances of which are to be interpreted to be to scale in some implementations while in other implementations, for each instance, not. In certain aspects, use of like or the same reference designators in the drawings and description refers to the same, similar or analogous components and/or elements, while according to other implementations the same use should not. According to certain implementations, use of directional terms, such as, top, bottom, left, right, up, down, over, above, below, beneath, rear, front, clockwise, and counterclockwise, are to be construed literally, while in other implementations the same use should not. While the invention will be described in conjunction with these specific embodiments, it will be understood that it is not intended to limit the invention to these embodiments. On the contrary, it is intended to cover alternatives, modifications, and equivalents as may be included within the spirit and scope of the invention as defined by the appended claims. In the following description, numerous specific details are set forth in order to provide a thorough understanding of the present invention. The present invention may be practiced without some or all of these specific details. In other instances, well-known process operations and components are not described in detail in order not to unnecessarily obscure the present invention. While drawings are illustrated in detail, it is appreciated that the quantity of the disclosed components may be greater or less than that disclosed, except where expressly restricting the amount of the components.

Figure 2:
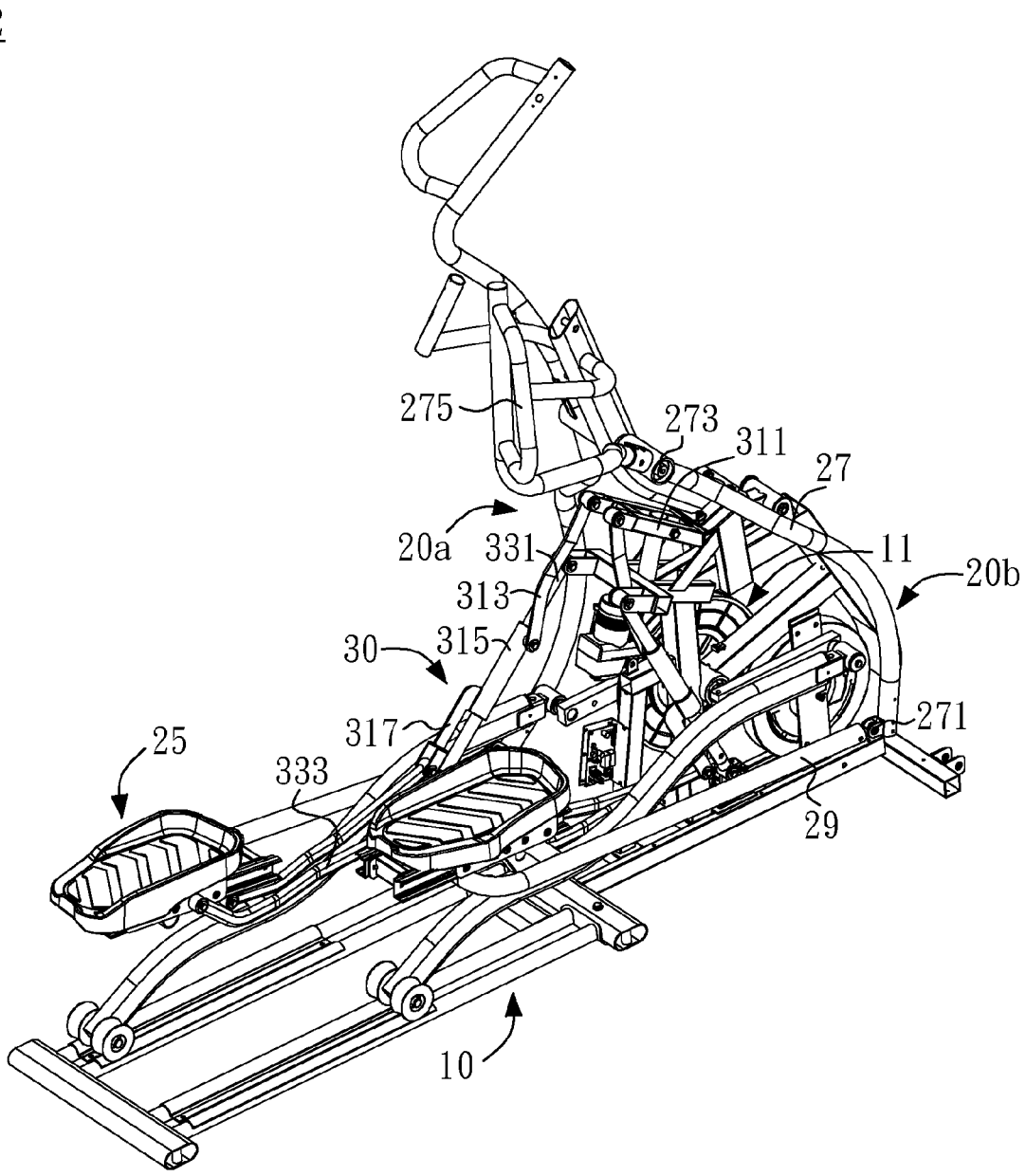
FIG. 2 is a front view showing an exercise device according to a preferred embodiment of the present invention.
Figure 3:
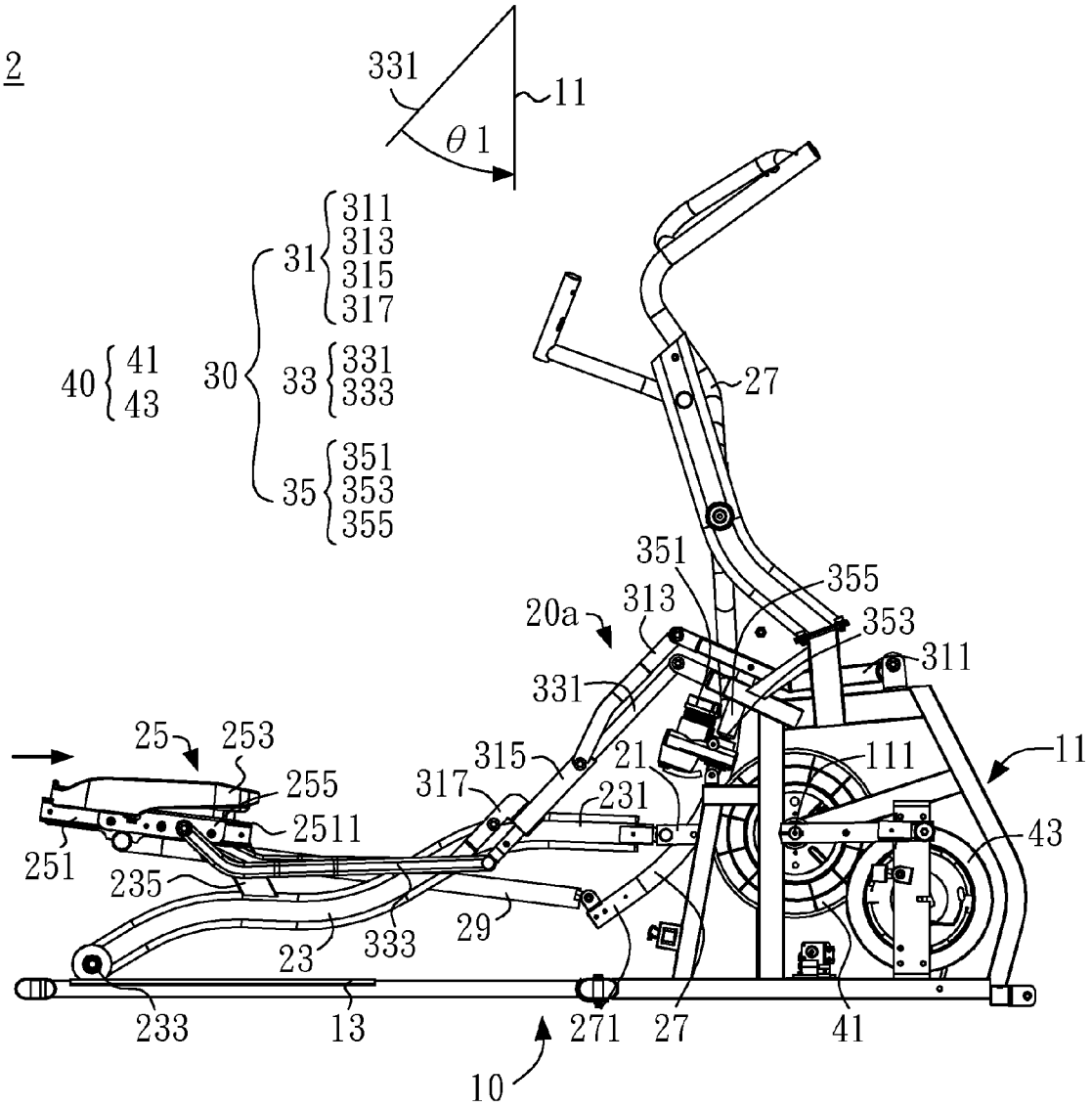
FIGS. 3-4 are side simplified views showing the exercise device according to the preferred embodiment of the present invention.
Figure 4:
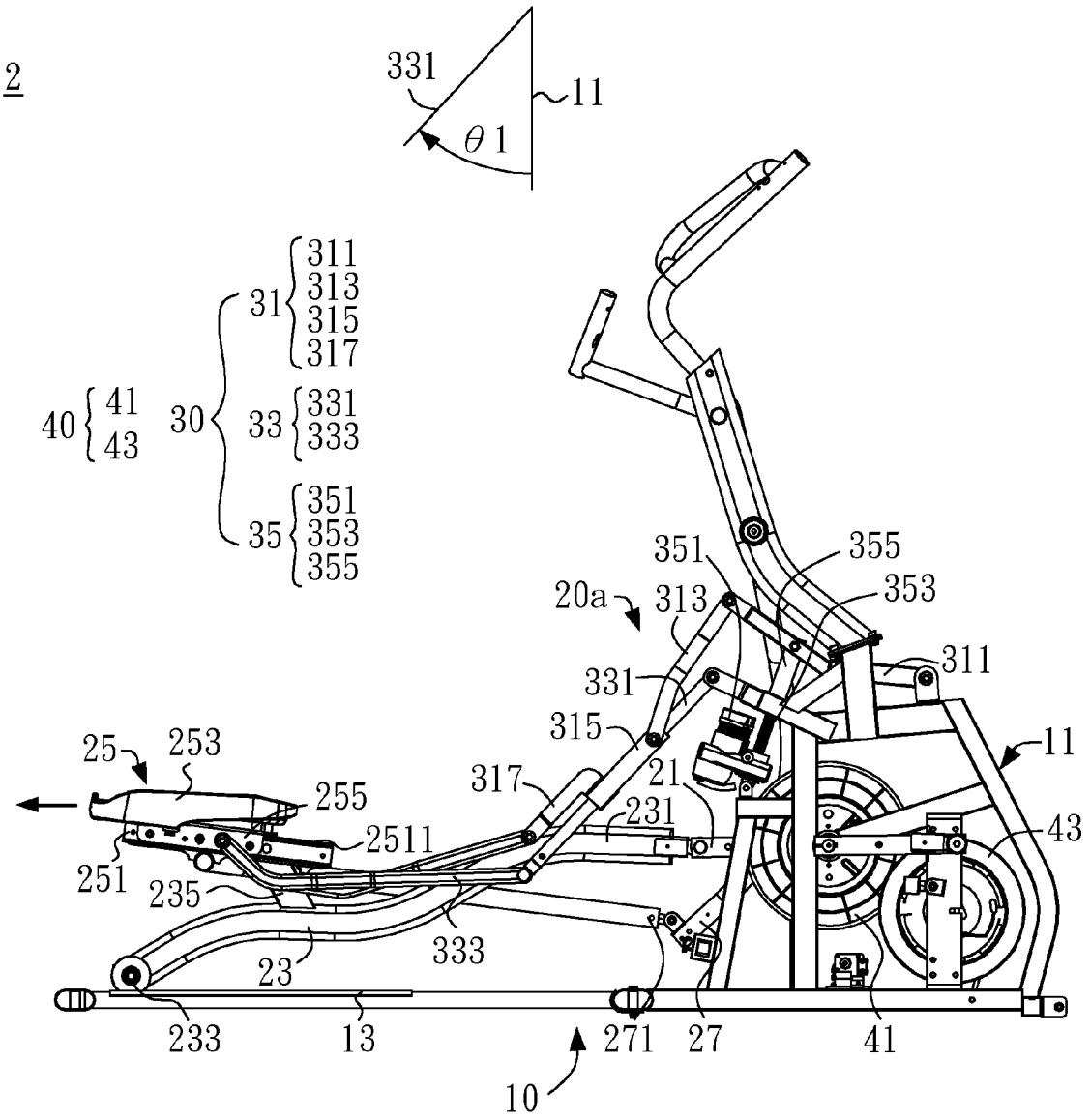

Referring to FIGS. 2-4, a preferred embodiment of the present invention provides an exercise device 2, such as en elliptical trainer 2, which can adjust step distance of the exercise device 2. The elliptical trainer 2 comprises a frame 10, a left and a right coupling mechanism 20*a*/20*b*, an adjusting mechanism 30, and a rotational mechanism 40.

For clarity and emphasis of essential features, FIGS. 3-4 merely show the left coupling mechanism 20*a* and a left swing structure 31 and a left linkage structure of the adjusting mechanism 30, and omits the right coupling mechanism 20*a*, a right swing structure, and a right linkage structure.

The frame 10 is arranged on a supporting surface or ground. A post structure 11 is upwardly extended from the front portion of the frame 10. The post structure 11 comprises an axis 111, and the left coupling mechanism 20*a* and the right coupling mechanism 20*b* are respectively arranged at either side of the post structure 11. The left coupling mechanism 20*a* or the right coupling mechanism 20*b* may comprise a crank 21, a supporting arm 23, a pedal assembly 25, a handrail 27, and a linkage 29. The supporting arm 23 may comprise a pivot portion 231, a sliding portion 233, and a supporting portion 235. The crank 21 has one end rotationally connected to the axis 111 and the other end pivotally coupled to the pivot portion 231 of the supporting arm 23. The sliding portion 233 is capable of sliding on the track 13 of the frame 10. Each pedal assembly 25 comprises a base 251, a pedal 253, and a slider 255. The base 251 pivotally connected with the supporting portion 235 and fixes with an end of the linkage 29. The handrail 27 comprises a pivot portion 271, a coupling portion 273, and a holding portion 275. The linkage 29 has another end coupling to the pivot portion 271 of the handrail 27. The holding portion 275 can be held by the user's hand. The coupling portion 273 pivotally couples with the post structure 11, so that the handrail 27 can swing around the coupling portion 273.

The rotational mechanism 40 is arranged at the post structure 11 and connects with the pedal assembly 25 via the left coupling mechanism 20*a* and the right coupling mechanisms 20*b*, respectively. The user drives the rotational mechanism 40 via the pedal assembly 25, which will make a moving path, e.g., an elliptical or elliptical-like moving path. The rotational mechanism 40 may comprise a driving wheel 41 and a flywheel 43. The driving wheel 41 pivotally couples with the axis 111 of the post structure 11, and can be driven by the crank 31. The flywheel 43 couples to the front portion of the frame 10. In this preferred embodiment, the driving wheel 41 employs a coupling member (not shown), such as a belt, as a medium to drive the flywheel 43.

The adjusting mechanism 30 comprises a (left/right) swing structure 31, a (left/right) linkage structure 33, and a driving device 35. Each swing structure 31 comprises a head structure 311, a first swing arm 313, a tube 315, and a second swing arm 317. The linkage structure 33 comprises a first linkage arm 331 and a second linkage arm 333. The driving device 35 can lift or lower the swing structure 31. In this preferred embodiment, the driving device may comprise, but is not limited to, a motor 351, a screw 353, and an internally-thread tube 355. The internally-thread tube 355 has an end coupled with the head structure 311. The internally-thread tube 355 couples with the screw 353 via its thread. The motor 351 can drive the screw 353 to rotate, making the internally-thread tube 355 moving along with the screw 353 in a direction of approaching or leaving the motor 351.

The head structure 311 has two ends in which one end couples the post structure 11 and the other end couples to an end of the first swing arm 313, and the other end of the first swing arm 313 couples to an end of the tube 315. The second swing arm 317 has an end coupling to the tube 315 and another end coupling to the base 251 of the pedal assembly 25. The first linkage arm 331 passes through the tube 315 and has two ends in which one end pivotally couples with the post structure 11 and the other end couples with the second linkage arm 333. The second linkage arm 333 has two ends, in which one end pivotally couples with the first linkage arm 331 and the other end connects with the slider 255. The base 251 comprises a track 2511 on which the slider 255 can move forward or backward.

Referring to FIG. 4, when the motor 351 drives the screw 353 to rotate and thus make the internally-threaded tube 355 moving away from the motor 351, the internally-threaded tube will push the head structure 311 to raise. By doing so, the tube 315 will be lifted along the first linkage arm 331 and thus pulls the first linkage arm 331 and the second linkage arm 333, such that the first linkage arm 331 and the second linkage arm 333 will extend toward the rear end of the exercise device, resulting in an angle θ between the first linkage arm 331 and the post structure 11 to be increased, and the slider 255 carried by the second linkage arm 333 being moved backward along the track 2511.

Referring to FIG. 3, when the motor 351 drives the screw 353 to rotate and thus make the internally-threaded tube 355 moving toward the motor 351, the internally-threaded tube 355 will pull the head structure 311 to lower. By doing so, the tube 315 will be lowered along the first linkage arm 331 and thus pulls the first linkage arm 331 and the second linkage arm 333, such that the first linkage arm 331 and the second linkage arm 333 will be drawn toward the front end of the exercise device, resulting in an angle θ between the first linkage arm 331 and the post structure 11 to be decreased, and the slider 255 carried by the second linkage arm 333 being moved forward along the track 2511.

FIGS. 3 and 4 merely show the left swing structure 31 and the left linkage structure 33, and omit the right swing structure 31 and the right linkage structure 33. In this preferred embodiment, the head structure 311 comprises a U-shaped configuration, as shown in FIG. 2. The U-shaped head structure 311 has two arms in which one arm pivotally couples with the left swing structure 31 and the other couples with the right swing structure 31.

Figure 5:
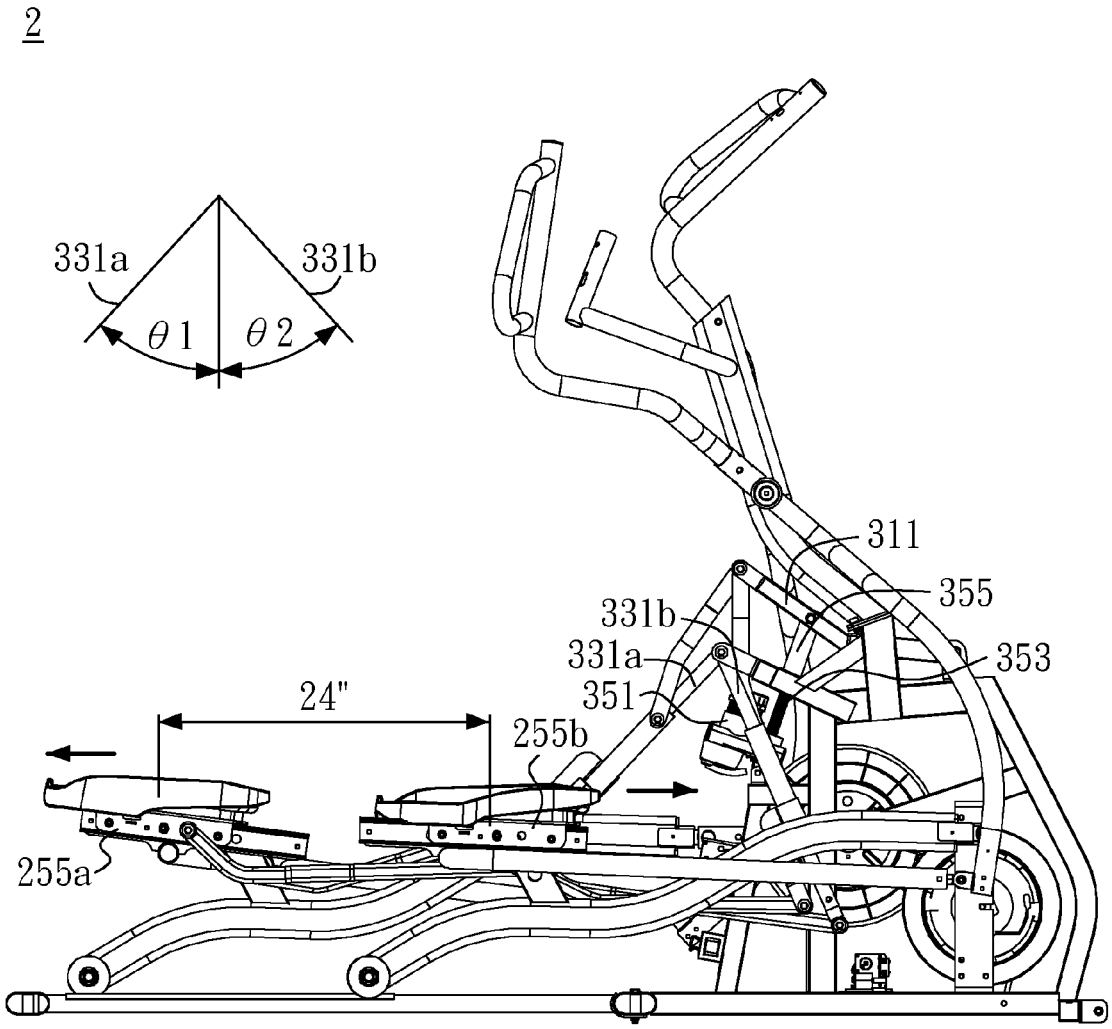
FIGS. 5-6 are side views showing two step distances of the exercise device according to the preferred embodiment of the present invention.
Figure 6:
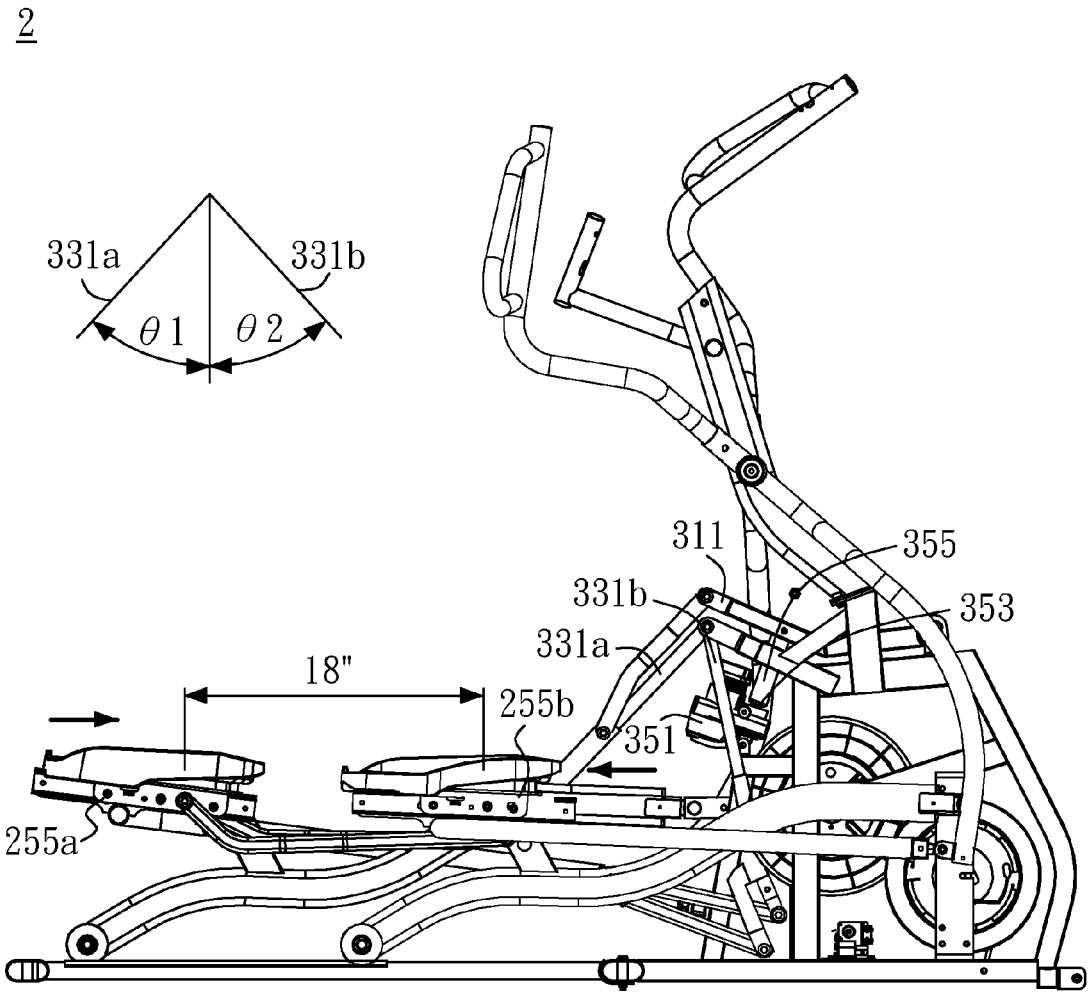

FIGS. 5 and 6 show both of the left and right swing structure 31 and left/right swing structure 33. As shown in FIG. 5, when the head structure 33 is lifted, the angle θ1 between the left linkage arm 331*a* and the post structure 11 is increased, and the angle θ2 between the right linkage arm 331*b* and the post structure 11 is increased, too. As a result, the slider 255*a* moves backward, and the slider 255*b* moves forward. Therefore, the step distance between the two pedals is increased, e.g., increased to 24 inches.

As shown in FIG. 6, when the head structure 33 is lowered, the angle θ1 between the left linkage arm 331*a* and the post structure 11 is decreased, and the angle θ2 between the right linkage arm 331*b* and the post structure 11 is decreased, too. As a result, the slider 255*a* moves forward, and the slider 255*b* moves backward. Therefore, the step distance between the pedals is decreased, e.g., decreased to 18 inches.

FIG. 5 shows the exercise device 2 with a maximum step distance, while FIG. 6 shows the exercise device 2 with a minimum step distance. By adjusting the position of the internally-threaded tube 355, the step distance can be adjusted between the maximum and the minimum.

Because the left and right swing structures 31 and the left and right linkage structures 33 are placed between the post structure 11 and the pedal assembly 25 and not couple with the cranks 21. Therefore, when changing the step distance, the transverse diameter of the elliptical or elliptical-like moving path will be increased or decreased, and the user needs not to raise his or her legs. The posture is ergonomic and the device can fit varied users.

The intent accompanying this disclosure is to have each/all embodiments construed in conjunction with the knowledge of one skilled in the art to cover all modifications, variations, combinations, permutations, omissions, substitutions, alternatives, and equivalents of the embodiments, to the extent not mutually exclusive, as may fall within the spirit and scope of the invention. Corresponding or related structure and methods disclosed or referenced herein, and/or in any and all co-pending, abandoned or patented application(s) by any of the named inventor(s) or assignee(s) of this application and invention, are incorporated herein by reference in their entireties, wherein such incorporation includes corresponding or related structure (and modifications thereof) which may be, in whole or in part, (i) operable and/or constructed with, (ii) modified by one skilled in the art to be operable and/or constructed with, and/or (iii) implemented/made/used with or in combination with, any part(s) of the present invention according to this disclosure, that of the application and references cited therein, and the knowledge and judgment of one skilled in the art.

Conditional language, such as, among others, "can," "could," "might," or "may," unless specifically stated otherwise, or otherwise understood within the context as used, is generally intended to convey that embodiments include, and in other interpretations do not include, certain features, elements and/or steps. Thus, such conditional language is not generally intended to imply that features, elements and/or steps are in any way required for one or more embodiments, or interpretations thereof, or that one or more embodiments necessarily include logic for deciding, with or without user input or prompting, whether these features, elements and/or steps are included or are to be performed in any particular embodiment.

All of the contents of the preceding documents are incorporated herein by reference in their entireties. Although the disclosure herein refers to certain illustrated embodiments, it is to be understood that these embodiments have been presented by way of example rather than limitation. For example, any of the particulars or features set out or referenced herein, or other features, including method steps and techniques, may be used with any other structure(s) and process described or referenced herein, in whole or in part, in any combination or permutation as a non-equivalent, separate, non-interchangeable aspect of this invention. Corresponding or related structure and methods specifically contemplated and disclosed herein as part of this invention, to the extent not mutually inconsistent as will be apparent from the context, this specification, and the knowledge of one skilled in the art, including, modifications thereto, which may be, in whole or in part, (i) operable and/or constructed with, (ii) modified by one skilled in the art to be operable and/or constructed with, and/or (iii) implemented/made/used with or in combination with, any parts of the present invention according to this disclosure, include: (I) any one or more parts of the above disclosed or referenced structure and methods and/or (II) subject matter of any one or more of the inventive concepts set forth herein and parts thereof, in any permutation and/or combination, include the subject matter of any one or more of the mentioned features and aspects, in any permutation and/or combination.

Although specific embodiments have been illustrated and described, it will be appreciated by those skilled in the art that various modifications may be made without departing from the scope of the present invention, which is intended to be limited solely by the appended claims.

What is claimed is:

1. An exercise device, comprising:

a frame with a post structure extended upward from a top portion of the frame;

a rotational mechanism placed at the post structure;

a left coupling mechanism and a right coupling mechanism respectively arranged at either side of the post structure, the left coupling mechanism and the right coupling mechanism each having a first end coupled with the rotational mechanism and a second end coupled with a left pedal assembly and a right pedal assembly, respectively;

an adjusting mechanism comprising:

a left linkage structure and a right linkage structure each having a first end pivotally coupled with the post structure and a second end coupled with the left pedal assembly and the right pedal assembly, respectively;

a left swing structure having a left tube and a right swing structure having a right tube, a first end of the left swing structure and a first end of the right swing structure coupling with the post structure, a second end of the left swing structure coupling to the left right pedal assembly, a second end of the right swing structure coupling to the right pedal assembly, the left linkage structure passing through the left tube of the left swing structure, the right linkage structure passing through the right tube of the right swing structure; and a driving device coupling to the left swing structure and the right swing structure to lift or lower the left swing structure and the right swing structure;

whereby an angle between the left linkage structure and the post structure and an angle between the right linkage structure and the post structure are adjustable so as to determine a step distance between the left pedal assembly and the right pedal assembly.

2. The exercise device of claim 1, wherein each of the left swing structure and the right swing structure further comprises a head structure, a first swing arm, and a second swing arm, wherein the head structure has two ends in which one end couples the post structure and the other end couples to an end of the first swing arm, the first swing arm comprises two ends in which one end couples to the head structure and the other end couples to an end of the left tube or the right tube, and the second swing arm has two ends in which one end couples to the left tube or the right tube and the other end couples to the left or right pedal assembly.

3. The exercise device of claim 2, wherein each of the left linkage structure and the right linkage structure comprises a first linkage arm and a second linkage arm, the first linkage arm passes through the left tube or the right tube and has two ends in which one end pivotally couples with the post structure and the other end couples with the second linkage arm, and the second linkage arm has two ends in which one end couples to the first linkage arm and the other end couples to the left or right pedal assembly.

4. The exercise device of claim 3, wherein each of the left pedal assembly and the right pedal assembly comprises a track, a pedal, and a slider, the slider is fixed with the pedal and can be slide forward or backward on the track, and the slider is coupled to an end of the second linkage arm.

5. The exercise device of claim 2, wherein the driving device comprises a motor, a screw, and an internally-threaded tube with an end coupled to the head structure.

6. The exercise device of claim 5, wherein the internally-threaded tube has thread to engage the screw, and the motor drives the screw to make the internally-threaded tube moving along a direction approaching to or leaving from the motor.

7. The exercise device of claim 1, wherein the post structure comprises an axis, and the left coupling mechanism and the right coupling mechanism respectively comprise a crank, a supporting arm, a handrail, and a linkage, in which the supporting arm comprise a pivot portion, a sliding portion, and a supporting portion, the crank has two ends in which one end connects to the axis and the other end pivotally coupled to the pivot portion of the supporting arm, the sliding portion is capable of sliding on a track of a rear portion of the frame, and the handrail comprises a pivot portion, a coupling portion, and a holding portion, in which the linkage has an end that couples to the left or right pedal assembly and another end that couples to the pivot portion of the handrail, the holding portion can be held by a user's hand, and the pivot portion of the handrail pivotally couples with the post structure.

8. The exercise device of claim 7, wherein the rotational mechanism comprises a driving wheel pivotally coupled with the axis and a flywheel pivotally coupled with the front portion of the frame, and the driving wheel drives the flywheel via a belt.

* * * * *